US010794089B2

(12) United States Patent
Fu et al.

(10) Patent No.: US 10,794,089 B2
(45) Date of Patent: Oct. 6, 2020

(54) SECURITY LOCK

(71) Applicant: Quanzhou Guoguang Software Development Co., Ltd., Fujian (CN)

(72) Inventors: Chaoyi Fu, Fujian (CN); Jiangping You, Fujian (CN); Changwei Ye, Fujian (CN); Zhisheng Hong, Fujian (CN); Dapan Hou, Fujian (CN)

( * ) Notice: Subject to any disclaimer, the term of this patent is extended or adjusted under 35 U.S.C. 154(b) by 0 days.

(21) Appl. No.: 16/348,156

(22) PCT Filed: Nov. 9, 2016

(86) PCT No.: PCT/CN2016/105138
§ 371 (c)(1),
(2) Date: May 8, 2019

(87) PCT Pub. No.: WO2018/085999
PCT Pub. Date: May 17, 2018

(65) Prior Publication Data

US 2019/0277063 A1 Sep. 12, 2019

(51) Int. Cl.
*E05B 47/06* (2006.01)
*E05B 47/00* (2006.01)
(Continued)

(52) U.S. Cl.
CPC ..... *E05B 47/0619* (2013.01); *E05B 15/14* (2013.01); *E05B 27/0003* (2013.01);
(Continued)

(58) Field of Classification Search
CPC ..... E05B 47/0619; E05B 47/00; E05B 15/14; E05B 27/0003; E05B 47/0012; E05B 49/00; E05B 47/0642; E05B 47/0638; E05B 47/0646; E05B 47/0649; E05B 47/0653; E05B 47/0661; E05B 47/0623; E05B 2047/0028; G07C 2009/00603; G07C 9/00706
(Continued)

(56) References Cited

U.S. PATENT DOCUMENTS 4,856,310 A * 8/1989 Parienti ..... E05B 47/0692 70/379 R
5,263,348 A * 11/1993 Wittwer ..... E05B 17/0058 70/223
(Continued)

*Primary Examiner* — Lloyd A Gall
(74) *Attorney, Agent, or Firm* — Prakash Nama; Global IP Services, PLLC

(57) ABSTRACT

A security lock, having a lock tongue, a key cylinder (20), and a key (30). The key cylinder (20) has a main body (21), a cover (22), and a connection assembly (40). The main body (21) has a channel (24). An electronic control assembly (50) and a mechanical control assembly (60) controlling the connection assembly (40) are provided within the main body (21). The key (30) has an elongate portion (31) and a grip portion (32). A power supply and a control chip are provided within the grip portion (32). The elongate portion (31) has bitting cuts (33) and a first contact member (34) connecting to the control chip. During an unlock operation, the key (30) is inserted into the channel (24), the first contact member (34) is communicatively connected to the electronic control assembly (50), and the bitting cuts (33) press against the mechanical control assembly (60).

10 Claims, 3 Drawing Sheets

(51) Int. Cl.
*E05B 49/00* (2006.01)
*E05B 27/00* (2006.01)
*E05B 15/14* (2006.01)

(52) U.S. Cl.
CPC ..... *E05B 47/00* (2013.01); *E05B 47/0012* (2013.01); *E05B 49/002* (2013.01)

(58) Field of Classification Search
USPC ..... 70/218, 223, 491–493, 496, 379 R, 70/379 A, 380, 278.1–278.3, 278.7, 279.1, 70/282, 283.1, 422, 472, 149, 188, 189
See application file for complete search history.

(56) References Cited

U.S. PATENT DOCUMENTS

| | | | | |
|---|---|---|---|---|
| 5,295,377 | A * | 3/1994 | Moricz | E05B 17/04 70/360 |
| 5,337,588 | A * | 8/1994 | Chhatwal | E05B 17/22 264/264 |
| 5,791,177 | A * | 8/1998 | Bianco | E05B 17/0062 70/189 |
| 6,384,711 | B1 * | 5/2002 | Cregger | G07C 9/27 340/5.65 |
| 7,966,854 | B2 * | 6/2011 | Imedio Ocana | E05B 47/0642 70/472 |
| 2006/0156771 | A1 * | 7/2006 | Hauri | E05B 47/0649 70/278.7 |
| 2007/0017265 | A1 * | 1/2007 | Andersson | E05B 47/0692 70/379 R |

* cited by examiner

SECURITY LOCK

BACKGROUND OF THE INVENTION

The present invention relates to a kind of lock, and more specifically relates to a security lock.

A lock is a common anti-theft device. A conventional lock is usually a mechanical anti-theft lock which can be opened by rotating a key cylinder using a key. However, its prevention against more skillful prying or prying by violent force is not satisfactory enough to meet the anti-theft requirements in the market.

Developments in electronic technology result in the launch of electric anti-theft lock. An electric anti-theft lock controls a mechanical mechanism to open or close by identifying and processing information electronically, and it is also a kind of lock that is somehow resistant to damage. Since the quantity of electronic encryption keys of an electric anti-theft lock can be a million times more than that of mechanical lock, an electrically controlled locking point can be configured flexibly and free from the limitation by the rotation of the key cylinder. As such, virtually unlimited designs are available for the prevention against skillful prying of the lock or prying of the lock by violent force.

Nowadays, an electric anti-theft lock usually achieves latching or unlatching of the lock by using an electromechanical device. In case of power failure, the consequence can be disastrous because the lock cannot be opened either from inside or outside. Accordingly, a mechanical key cylinder is required as a backup mechanism to open the lock, but the use of mechanical key cylinder again has the safety problems as discussed in that it leaves room for skillful prying of the lock or prying of the lock by violent force.

Technical Problem in the Prior Art

Use of a mechanical key cylinder in an electric anti-theft lock as a backup mechanism to open the electric anti-theft lock has safety problems in that it leaves room for skillful prying of the lock or prying of the lock by violent force.

BRIEF SUMMARY OF THE INVENTION

In view of the aforesaid disadvantages now present in the prior art, the present invention provides a security lock, comprising A security lock, comprising a lock tongue, a key cylinder and a key; the key cylinder comprises a body, a cap configured co-axially with the body, and a connection assembly that connects or disconnects motion transmission between the body and the cap; the cap and the lock tongue are connected to transmit motion; the body is provided with a channel into which the key is inserted; an electric control assembly and a mechanical control assembly that control movement of the connection assembly are provided inside the body; the key comprises an elongated portion and a grip portion fixedly connected to one end of the elongated portion; a power supply and a control chip mutually connected to each other are provided within the grip portion; bitting cuts are provided on the elongated portion; a first contact piece connected with the control chip is also provided on the elongated portion; when unlocking the security lock, the key is inserted into the channel, wherein the first contact piece communicates with the electric control assembly, and the bitting cuts abut against the mechanical control assembly.

Preferably, an end of the body facing towards the cap is provided with a locking groove; an end of the cap facing towards the body is provided with a blocking groove; the connection assembly comprises a weighed plate inserted into the locking groove, an abutting plate inserted into the blocking groove, and a first spring having one end abutting against the cap; another end of the first spring abuts against an end of the abutting plate distal from the body; the weighed plate has a length shorter than a depth of the locking groove along the depth of the locking groove; when unlocking the security lock, the abutting plate is inserted simultaneously into both the locking groove and the blocking groove; when the security lock is locked, an end face of an end of the weighed plate facing towards the cap aligns with an end face of the body.

Preferably, the first spring is a conical spring.

Preferably, the electric control assembly comprises a control circuit board, and a first spring-loaded contact pin and a rotation motor both connected to the control circuit board; a contact head of the first spring-loaded contact pin is located within the channel; an output shaft of the rotation motor is fixedly connected with a position limiting flange; a slot is provided at an end of the position limiting flange facing towards the weighed plate; a cross section of the slot has a shape of a trapezium; the slot is in communication with the locking groove; when unlocking the security lock, the first spring-loaded contact pin contacts with the first contact piece, the weighed plate is inserted simultaneously in both the slot and the locking groove; when the security lock is locked, the weighed plate abuts against an end face of the position limiting flange.

Preferably, a second contact piece electrically connected with the power supply is also provided on the elongated portion; the electric control assembly also comprises a second spring-loaded contact pin electrically connected with the control circuit board; when unlocking the security lock, the second contact piece contacts with the second spring-loaded contact pin.

Preferably, the body is provided with a pin hole in communication with the channel; the position limiting flange is provided with a reset portion which has a flat shape; an axis of the position limiting flange is perpendicular to the pin hole; the electric control assembly also comprises a reset pin and a third spring; the reset spring is slidably received within the pin hole; one end of the third spring abuts against an end of the reset pin distal from the channel; another end of the third spring directly or indirectly abuts against the body; the reset pin is provided with a reset groove in cooperation with the reset portion; when unlocking the security lock, the end of the reset pin distal from the third spring abuts against the elongated portion; the reset portion is inserted into the reset groove; when the security lock is locked, an end of the reset pin distal from the third spring is located within the channel; the reset portion abuts against a side wall of the reset pin.

Preferably, the slot is opened at two ends thereof.

Preferably, the slot has an opening at only one end thereof; another end of the slot is spaced apart from a side wall of the position limiting flange by a predetermined distance; a platform corresponding to the slot is provided on the weighed plate.

Preferably, the body is provided with more than one toothed slot around the body; each toothed slot is perpendicular to the channel and is in communication with the channel; the mechanical control assembly comprises more than one pin ring; a quantity of the pin ring is the same as a quantity of the toothed slot; each pin ring is slidably received in a corresponding toothed slot; each pin ring comprises a second spring, a first portion and a second portion; one end of the first portion abuts against one end of the second portion; another end of the first portion and another end of the second portion abut against two ends of the second spring respectively; the first portion and the second portion are provided with teeth respectively corresponding to the bitting cuts at positions corresponding to the channel; a weighed plate groove is provided at a predetermined position on each of the first portion and the second portion; when unlocking the security lock, the weighed plate inserts into the weighed plate grooves.

Preferably, the key cylinder also comprises a shell, and a sleeve cylinder that sleeves the body; the body is received in the sleeve cylinder by interference fit; the sleeve cylinder, the body and the cap are all within shell.

Preferably, an end of the cap facing towards the body is provided with a stepped hole; an end of the body facing towards the cap is provided with a stud that inserts into the stepped hole; the stud is sleeved with an anti-resistant gasket; two sides of the weighed plate are provided with notches respectively that receive the anti-resistant gasket.

Beneficial Effect of the Present Invention

1. On the basis of conventional mechanical anti-theft lock, the present invention provides a control chip and contact pieces on the key, and provides an electric control assembly on the key cylinder, such that the security lock provided by the present invention can only be opened when both the electric encryption key is correct and a key with correct bitting cuts is used. Therefore, the present invention is safer in that it effectively prevents skillful prying or prying by using violent force.

2. The present invention does not require conventional electromechanical locking mechanism, and so it is more reliable in that the serious situation where the lock cannot be opened from inside or outside in case of power failure as happened in the prior art will not occur in the present invention.

DETAILED DESCRIPTION OF THE INVENTION

Figure 1:
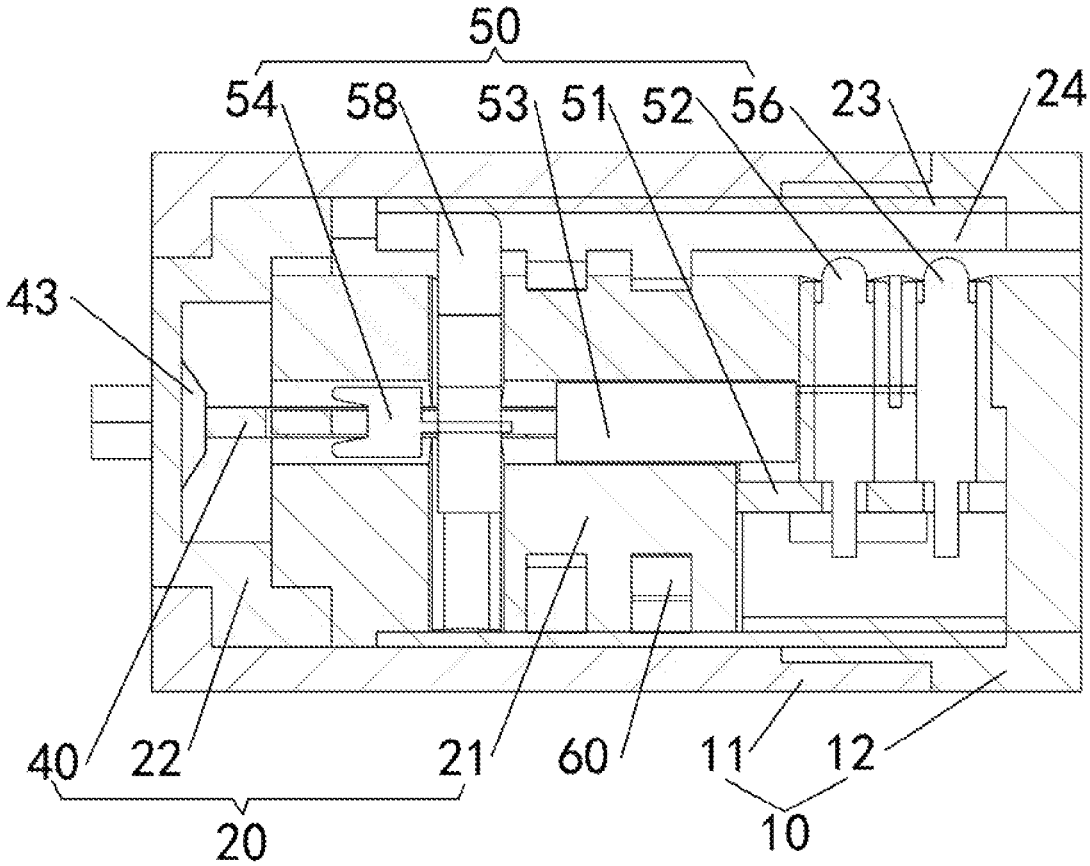
FIG. 1 is a sectional view showing the structure of the security lock according to the present invention, wherein some parts of the lock are omitted in the figure.
Figure 2:
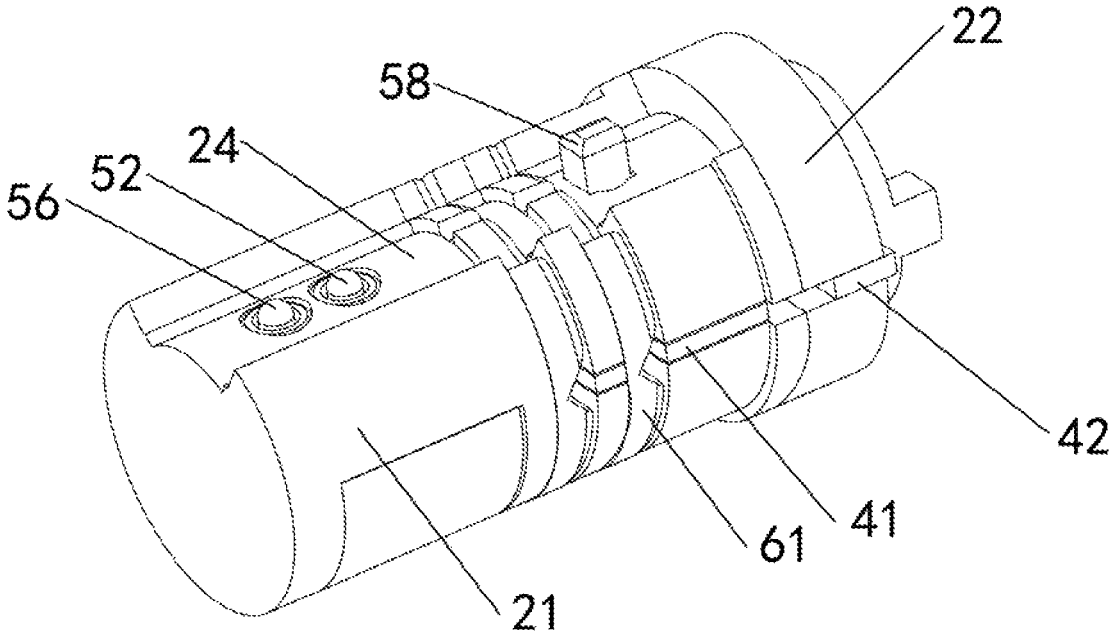
FIG. 2 is a schematic structural view of the security lock according to the present invention, wherein some parts of the lock are omitted.
Figure 3:
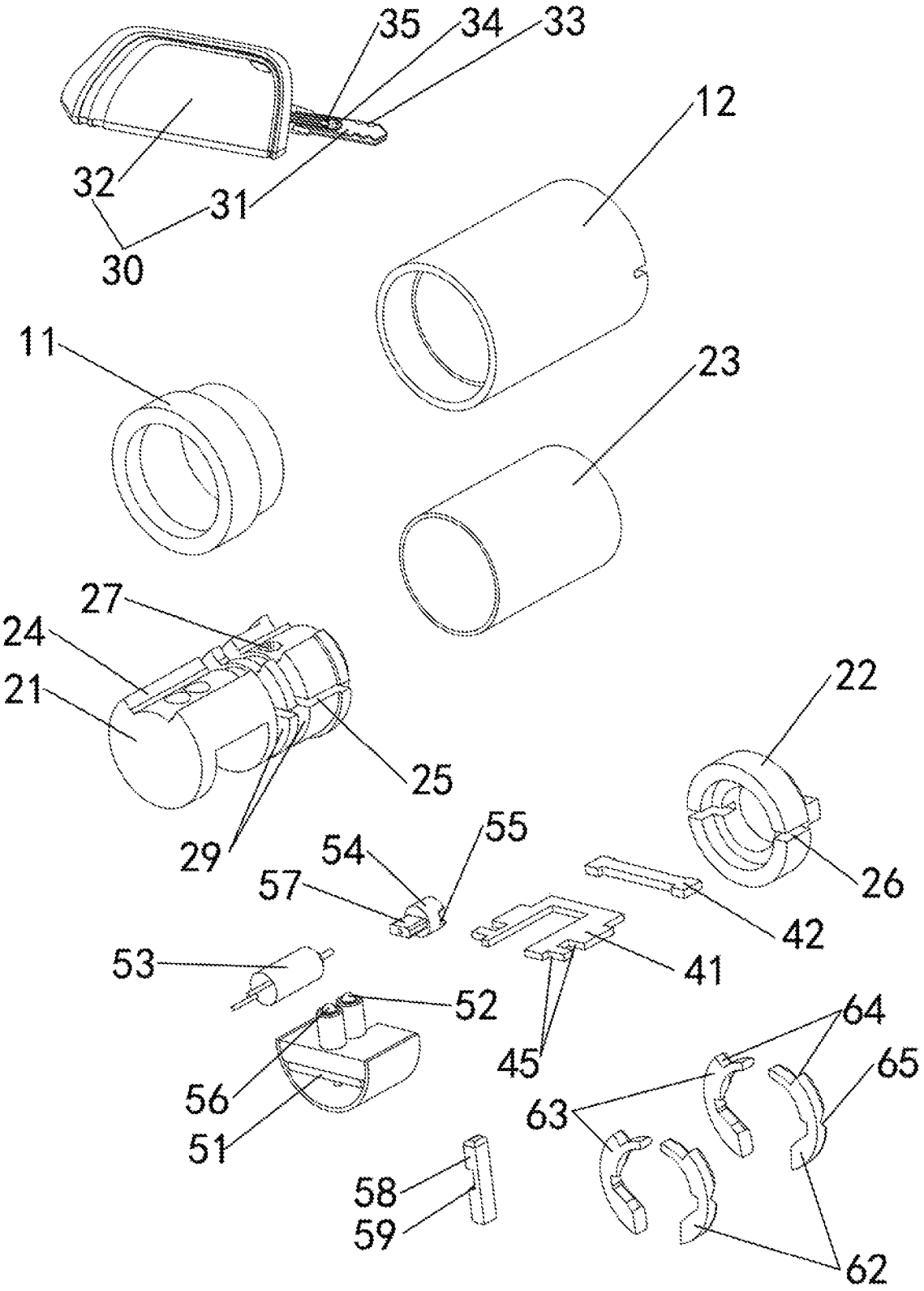
FIG. 3 is an exploded view showing the structure of the security lock according to the present invention, wherein some parts of the lock are omitted.

As shown in FIGS. 1-3, the present invention provides a security lock, comprising a shell 10, a lock tongue (not shown in the figures), a key cylinder 20 and a key 30. The lock tongue is an ordinary lock tongue currently available in the market, and therefore will not be described in detail herein.

The shell 10 comprises a front shell 11 and a rear shell 12 rotationally connected to the front shell 11. The front shell 1 land the rear shell 12 are both revolving tubular cylinders.

The key cylinder 20 is limited within the shell 10; the key cylinder 20 comprises a body 21, a cap 22 configured co-axially with the body 21, and a connection assembly 40 that connects or disconnects motion transmission between the body 21 and the cap 22; the cap 22 and the lock tongue are connected for motion transmission such that the cap drives the lock tongue to open or close the lock; the body 21 is sleeved by a sleeve cylinder 23 by interference fit. In other words, the sleeve cylinder 23, the body 21 and the cap 22 are all within shell 10, wherein the sleeve cylinder 23 and the cap 22 are rotationally connected with the shell 10 respectively.

The body 21 is provided with a channel 24 for insertion of the key 30; specifically, the channel 24 is a groove provided on the body 21; one end of the groove communicates with external environment for insertion of the key 30, and another end of the groove is located on the body 21; when the sleeve cylinder 23 sleeves the body 21, the channel 24 and an inner side wall of the sleeve cylinder 23 together define a key hole. Also, an electric control assembly 50 and a mechanical control assembly 60 that control movement of the connection assembly 40 are provided inside the body 21.

The key 30 comprises an elongated portion 31 and a grip portion 32 fixedly connected to one end of the elongated portion 31; a power supply and a control chip mutually connected to each other are provided within the grip portion 32, wherein the control chip is an ordinary electrical chip available in the market mainly for storage of electric encryption keys. Such an electrical chip only requires storage function and is therefore relatively smaller such that the key 30 can be more portable. Further, the grip portion 32 can also be provided with a charging port. Bitting cuts 33 are provided at each of two sides of the elongated portion 31; a first contact piece 34 in communication with the control chip is provided on the elongated portion 31.

In an initial condition when the security lock is in a locked condition, connection between the body 21 and the cap 22 is cut off by the connection assembly 40, and the body 21 can rotate with respect to the cap 22, while the electric control assembly 50 and the mechanical control assembly 60 limit the movement of the connection assembly 40; when the security lock is being unlocked, the elongated portion 31 of the key 30 is inserted into the channel 24, wherein the first contact piece 34 communicates with the electric control assembly 50, the electric control assembly 50 receives an electric encryption key stored inside the electrical chip via the first contact piece 34, checks the electric encryption key, and then removes the restriction on the connection assembly 40 if the electric encryption key is correct, while the bitting cuts 33 abut against the mechanical control assembly 60 to drive the mechanical control assembly 60 to remove the restriction on the connection assembly 40; and then the connection assembly 40 can move by either internal or external action forces to achieve motion transmission connection between the body 21 and the cap 22; therefore, by turning the key 30, the body 21 can drive the cap 22 to rotate which in turns drives the lock tongue to move and thereby achieving unlocking of the security lock. To lock the security lock, the key 30 is removed from the channel 24, and the communication between the electric control assembly 50 and the electrical chip is cut off, therefore the connection assembly 40, the electric control assembly 50 and the mechanical control assembly 60 reset simultaneously, thereby locking the security lock again.

The connection assembly 40 can be an ordinary locking assembly, such as an electromagnetic assembly. Preferably, according to an embodiment of the present invention, an end of the body 21 facing towards the cap 22 is provided with a locking groove 25; an end of the cap 22 facing towards the body 21 is provided with a blocking groove 26; preferably, the locking groove and the blocking groove have the same width. The connection assembly 40 comprises a weighed plate 41 inserted into the locking groove 25, an abutting plate 42 inserted into the blocking groove 26, and a first spring 43 having one end abutting against the cap 22; another end of the first spring 43 abuts against an end of the abutting plate 42 distal from the body 41; the first spring 43 is compressed, such that the first spring 43 can in real time applies an action force along a direction towards the body 21. Further, the first spring 43 is preferably a conical spring.

The weighed plate 41 has a length shorter than a depth of the locking groove along the depth of the locking groove 25, so as to ensure that the weighed plate 41 can slide along the depth of the locking groove 25. In an initial condition where the security lock is locked, an end face of an end of the weighed plate 41 facing towards the cap 22 aligns with an end face of the body 21; an end of the abutting plate 42 facing towards the body 21 abuts against the end face of the body 21 or the end face of the weighed plate 41 under the action force of the first spring 43, wherein the electric control assembly 50 and the mechanical control assembly 60 limit the movement of the weighed plate 41 such that the weighed plate 41 cannot slide within the locking groove 25; when unlocking the security lock, turning of the key 30 drives the body 21 to rotate, and when the body 21 is rotated to a position where the locking groove 25 aligns with the blocking groove 26, the abutting plate 42 abuts against the end face of the weighed plate 41; since the electric control assembly 50 and the mechanical control assembly 60 remove the restriction on the weighed plate 41 of the connection assembly 40, the abutting plate 42, under the action force of the first spring 43, pushes the weighed plate 41 to slide in the locking groove 25 along a direction away from the cap 22; it should be noted that, a length which the weighed plate slides in the locking groove 25 can be determined according to practical situation, but it should be ensured that after the abutting plate 42 pushes the weighed plate 41, the abutting plate 42 itself is located both within the locking groove 25 and the blocking groove 26 so as to ensure that the cap 22 can rotate together with the body 21. Moreover, in case a wrong key 30 is used, and the electric control assembly 50 and the mechanical control assembly 60 do not remove the restriction on the weighed plate 4 of the connection assembly 40, the key 30 can only drive the body 21 to rotate with respect to the cap 22, meaning that the body 21 is able to freely rotate without driving the cap 22 to rotate, and such configuration can prevent breaking the key in case a wrong key is turned.

Preferably, according to an embodiment of the present invention, an end of the cap 22 facing towards the body 21 is provided with a stepped hole; the first spring 43 abuts against a bottom side of the stepped hole; an end of the body 21 facing towards the cap 22 is provided with a stud that inserts into the stepped hole; the stud is sleeved with anti-resistant gasket (not shown in the figures); two sides of the weighed plate 41 are provided with notches respectively that give way to the anti-resistant gasket. These configurations prevent abrasion of the cap 22 or the body 21 at the time the cap 22 and the body 21 rotate with respect to each other.

The electric control assembly 50 comprises a control circuit board 51, and a first spring-loaded contact pin 52 and a rotation motor 53 both connected to the control circuit board 51; the control circuit board 51 is an ordinary circuit board available in the market mainly for verifying the electric encryption keys and controlling an working sequence of the rotation motor 53. The control circuit board will not be described in detail herein. A contact head of the first spring-loaded contact pin 52 is located within the channel 24; the first spring-loaded contact pin 52 is perpendicular to the channel 24; an output shaft of the rotation motor 53 is fixedly connected with a position limiting flange 54; the weighed plate 41 is positioned between the position limiting flange 54 and the abutting plate 42; a slot 55 is provided at an end of the position limiting flange 54 facing towards the weighed plate; a cross section of the slot 55 has a shape of a trapezium; the slot 55 is in communication with the locking groove 25.

In an initial condition where the security lock is locked, the weighed plate 41 abuts against an end face of the position limiting flange 54, and the slot 5 and the weighed plate 41 are perpendicular to each other; when the security lock is unlocked, the first spring-loaded contact pin 52 contacts with the first contact piece 34, and then the control circuit board 51 receives from the first contact piece 34 an electric encryption key stored in the electrical chip, checks the electric encryption key received, and then control the rotation motor 53 to rotate the position limiting flange 54 by 90 degrees or 270 degrees if the electric encryption key is correct, such that the slot 55 and the weighed plate 41 align with each other, and as such, the weighed plate 41 no longer abuts against the end face of the position limiting flange 54, instead, the weighed plate 41 will slide into the slot 55 under the pushing force of the abutting plate 42, such that the weighed plate 41 is positioned simultaneously in both the slot 55 and the locking groove 25.

Preferably, according to an embodiment of the present invention, a second contact piece 35 electrically connected with the power supply is also provided on the elongated portion 31; the electric control assembly 50 also comprises a second spring-loaded contact pin 56 electrically connected with the control circuit board 51; when unlocking the security lock, the second contact piece 35 contacts with the second spring-loaded contact pin 56 such that the power supply on the key 30 can also provide power to the control circuit board 51, in other words, the power required by the electric control assembly 50 is provided by the power supply of the key 30. Therefore, the electric control assembly 50 does not require external power source, thereby eliminating the impact on the use of the security lock at the time of external power failure, and at the same time increasing the safety level of the security lock.

Besides, the body 21 is provided with a pin hole 27 in communication with the channel 24; the position limiting flange 54 is provided with a reset portion 57 which has a flat shape; an axis of the position limiting flange 54 is perpendicular to the pin hole 27; the electric control assembly 50 also comprises a reset pin 58 and a third spring (not shown in the figures); the reset spring 58 is slidably received within the pin hole 27; one end of the third spring abuts against an end of the reset pin 58 distal from the channel 24; another end of the third spring directly or indirectly abuts against the body 21. In the present embodiment, the third spring indirectly abuts against the body 21 by abutting against an inner side wall of the sleeve cylinder 23. The third spring biases the reset pin 58 to a direction towards the channel 24.

The reset pin 58 is provided with a reset groove 59 in cooperation with the reset portion 57. In an initial condition where the security lock is locked, an end of the reset pin 28 distal from the third spring is located within the channel 24; the reset portion 57 abuts against a side wall of the reset pin 58 to limit the rotation of the position limiting flange 54. When unlocking the security lock, the elongated portion 31 is inserted into the channel 24, and the elongated portion 31 will then push the reset pin 58 towards the third spring, where the end of the reset pin 58 distal from the third spring abuts against the elongated portion 31; following the movement of the reset pin 58, the reset groove 59 also moves to a position corresponding to the position limiting flange 54, so that the reset portion 57 no longer abuts against the side wall of the reset pin 58, or so that the reset portion 57 abuts against the reset pin 58 at a position proximal to the reset groove 59, and then the reset portion 57 is inserted into the reset groove 59 following the rotation of the position limiting flange 54; when the key 30 is removed, the reset pin 58 resets towards a direction distal from the third spring under the action force of the third spring; as the reset pin 58 resets, the reset groove 59 also moves; when the rest groove 59 moves as the reset pin 58 resets, a side wall of the reset groove 59 pushes the reset portion 57 which in turns drives the position limiting flange 54 to rotate, so that the weighed plate 41 slides out of the slot 55 having the trapezium shaped cross section along a side wall of the slot 55, thereby resetting the weighed plate 41; as the weighed plate 41 resets, the weighed plate 41 pushes the abutting plate 42 out of the locking groove 25, thereby resetting the abutting plate 42; accordingly, the connection assembly 40 cuts off the connection between the body 21 and the cap 22.

Figure 4:
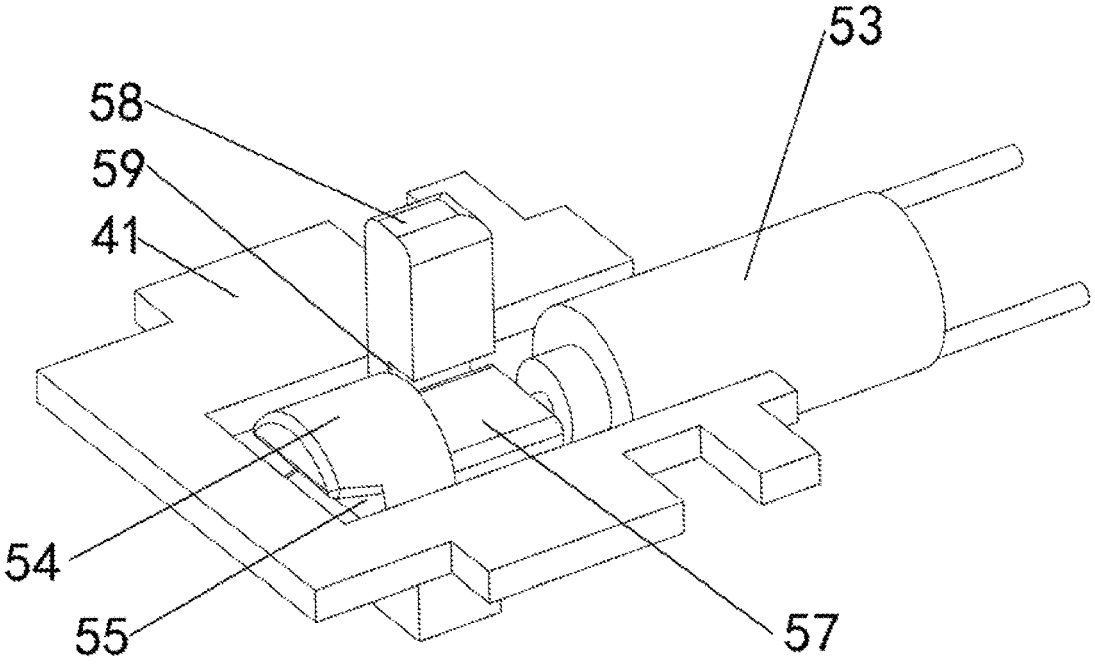
FIG. 4 is a schematic view showing a first structure defined by the position limiting flange, the reset pin and the weighed plate.

The present invention provides two different structures for the slot 55. As shown in FIG. 4, a first structure is disclosed wherein the slot 55 is opened at its two ends, in other words, the slot 55 is a through slot, therefore the weighed plate 41 can insert directly into the slot 55. By using the first structure, every complete rotation of the position limiting flange 54 allows the weighed plate 41 to be inserted to the slot 55 twice. FIG. 4 shows a condition where the reset portion 57 is inserted into the reset groove 59 and the weighed plate 41 is ready to be inserted into the slot 55.

Figure 5:
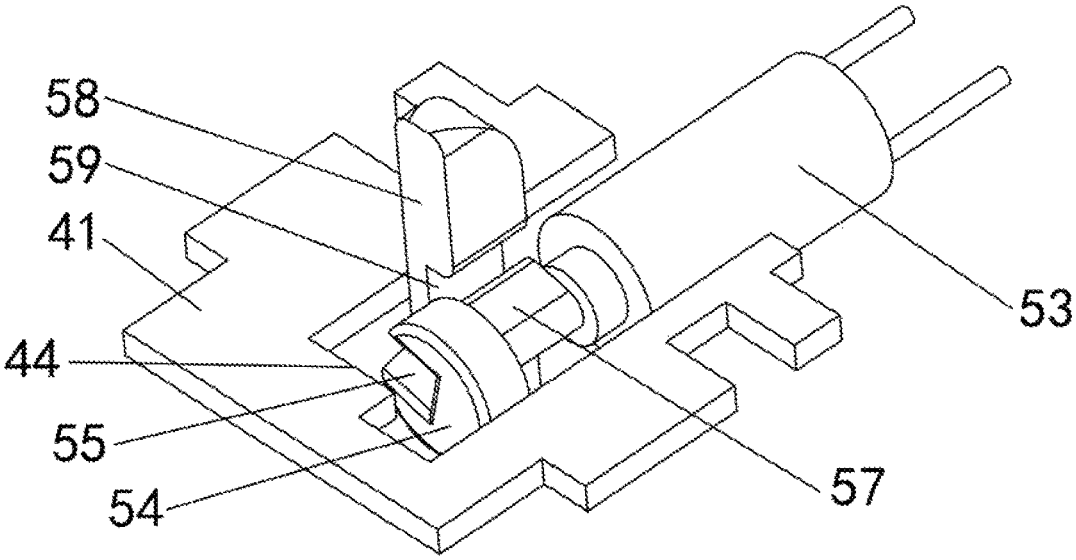
FIG. 5 is a schematic view showing a second structure defined by the position limiting flange, the reset pin and the weighed plate.

FIG. 5 shows a second structure for the slot 55, wherein the slot 55 has an opening at only one end; another end of the slot 55 is spaced apart from a side wall of the position limiting flange 54 by a predetermined distance. In other words, said another end of the slot 55 is positioned in an interior portion of the position limiting flange 54, and the end of the slot 55 having the opening is in communication with an external environment out of the position limiting flange 54; a platform 44 corresponding to the slot 55 is provided on the weighed plate 41. By using this second structure, every complete rotation of the position limiting flange 54 allows the weighed plate 41 to be inserted into the slot 55 once, thereby being safer. FIG. 5 shows a condition where the reset pin 58 is pushed by the elongated portion 31 to an extreme position towards the third spring, and where the rotation motor 53 is not yet activated to drive the rotation of the position limiting flange 54. At this condition, the reset portion 57 still abuts against the reset pin 58, and requires to be turned 270 degrees before it can be inserted into the reset groove 59.

The mechanical control assembly 60 can be an ordinary control assembly used in a mechanical anti-theft lock, such as a pin tumbler structure. Preferably, in the embodiment as shown in FIGS. 1-3, the body 21 is provided with more than one toothed slot 29 around the body 21; each toothed slot 29 is perpendicular to the channel 24 and is in communication with the channel 24; the mechanical control assembly 60 comprises more than one pin ring 61; a quantity of the pin ring is the same as a quantity of the toothed slot 29. It should be noted that, the quantity of the toothed slot 29 can be determined according to practical situation. In the embodiment as shown and will be described, there are two toothed slots 29.

Each pin ring is slidably received on a corresponding toothed slot; each pin ring 61 comprises a second spring (not shown in the figures), a first portion 62 and a second portion 63; one end of the first portion 62 abuts against one end of the second portion 63; another end of the first portion 62 and another end of the second portion 63 abut against two ends of the second spring respectively. The end of the first portion 62 and the end of the second portion 63 abutting against one another are positioned at where the toothed slot 29 corresponds to the channel 24, and are provided with teeth 64 respectively corresponding to the bitting cuts 33; a weighed plate groove 65 is provided at a predetermined position on each of the first portion 62 and the second portion 63. Preferably, the weighed plate groove 65 is a V-shaped groove. Also, recesses 45 are provided on the weighed plate 41 corresponding to the first portion 62 and the second portion 63; each of the first portion 62 and the second portion 63 are inserted into a corresponding recess 45 respectively.

In an initial condition where the security lock is locked, the first portion 62 and the second portion 63 are inserted into the recesses 45, and the positions of the first portion 62 and the second portion 63 inserted corresponding to the recesses 45 are positions on the first portion 62 and the second portion 63 not provided with the weighed plate grooves 65; when unlocking the security lock, the bitting cuts 33 on the elongated portion 31 abut against the corresponding teeth 64 of the first portion 62 and the second portion 63, and the teeth 64 in turns drive the first portion 62 and the second portion 63 to slide within the corresponding toothed slot 29, such that the ends of the first portion 62 and the second portion 63 abutting against each other are separated from each other, the second spring being compressed, and the weighed plate grooves 65 of the first portion 62 and the second portion 63 slide to align with the weighed plate 41; as such, the weighed plate 41 will insert into the weighed plate grooves 65 under the driving force of the abutting plate 42, in other words, the weighed plate 41 is inserted into the weighed plate grooves 65; when the key 30 is removed, the bitting cuts 33 are withdrawn from abutting against the teeth 64, and then the first portion 62 and the second portion 63 reset under the action force of the second spring, such that the weighed plate grooves 65 reset as well; accordingly, the weighed plate 41 will slides out of the weighed plate grooves 65 along the V-shaped side walls of the weighed plate grooves 65; as a result, the weighed plate 41 resets as well.

The present invention provides a security lock that requires simultaneous operations of the electric control assembly 50 and the mechanical control assembly 60 to achieve motion transmission between the body 21 and the cap 22. Therefore, the present invention has the reliability of a mechanical anti-theft lock and also the safety provided by an electric anti-theft lock.

What is claimed is:

1. A security lock, comprising a lock tongue, a key cylinder and a key; wherein the key cylinder comprises a body, a cap configured co-axially with the body, and a connection assembly that connects or disconnects motion transmission between the body and the cap; the cap and the lock tongue are connected to transmit motion; the body is provided with a channel into which the key is inserted; an electric control assembly and a mechanical control assembly that control movement of the connection assembly are provided inside the body; the key comprises an elongated portion and a grip portion fixedly connected to one end of the elongated portion; a power supply and a control chip mutually connected to each other are provided within the grip portion; bitting cuts are provided on the elongated portion; a first contact piece connected with the control chip is also provided on the elongated portion; when unlocking the security lock, the key is inserted into the channel, wherein the first contact piece communicates with the electric control assembly, and the bitting cuts abut against the mechanical control assembly.

2. The security lock of claim 1, wherein an end of the body facing towards the cap is provided with a locking groove: an end of the cap facing towards the body is provided with a blocking groove; the connection assembly comprises a weighed plate inserted into the locking groove, an abutting plate inserted into the blocking groove, and a first spring having one end abutting against the cap; another end of the first spring abuts against an end of the abutting plate distal from the body; the weighed plate has a length shorter than a depth of the locking groove along the depth of the locking groove; when unlocking the security lock, the abutting plate is inserted simultaneously into both the locking groove and the blocking groove;

when the security lock is locked, an end face of an end of the weighed plate facing towards the cap aligns with an end face of the body.

3. The security lock of claim 2, wherein the first spring is a conical spring.

4. The security lock of claim 2, wherein the electric control assembly comprises a control circuit board, and a first spring-loaded contact pin and a rotation motor both connected to the control circuit board; a contact head of the first spring-loaded contact pin is located within the channel; an output shaft of the rotation motor is fixedly connected with a position limiting flange; a slot is provided at an end of the position limiting flange facing towards the weighed plate; a cross section of the slot has a shape of a trapezium; the slot is in communication with the locking, groove; when unlocking the security lock, the first spring-loaded contact pin contacts with the first contact piece, the weighed plate is inserted simultaneously in both the slot and the locking groove; when the security lock is locked, the weighed plate abuts against an end face of the position limiting flange.

5. The security lock of claim 4, wherein a second contact piece electrically connected with the power supply is also provided on the elongated portion; the electric control assembly also comprises a second spring-loaded contact pin electrically connected with the control circuit board; when unlocking the security lock, the second contact piece contacts with the second spring-loaded contact pin.

6. The security lock of claim 4, wherein the body is provided with a pin hole in communication with the channel: the position limiting flange is provided with a reset portion which has a flat shape; an axis of the position limiting flange is perpendicular to the pin hole;

the electric control assembly also comprises a reset pin and a third spring; the reset spring is slidably received within the pin hole; one end of the third spring abuts against an end of the reset pin distal from the channel; another end of the third spring directly or indirectly abuts against the body; the reset pin is provided with a reset groove in cooperation with the reset portion; when unlocking the security lock, the end of the reset pin distal from the third spring abuts against the elongated portion; the reset portion is inserted into the reset groove; when the security lock is locked, an end of the reset pin distal from the third spring is located within the channel; the reset portion abuts against a side wall of the reset pin.

7. The security lock of claim 6, wherein the slot is opened at two ends thereof.

8. The security lock of claim 6, wherein the slot has an opening at only one end thereof: another end of the slot is spaced apart from a side wall of the position limiting flange by a predetermined distance; a platform corresponding to the slot is provided on the weighed plate.

9. The security lock of claim 2, wherein the body is provided with more than one toothed slot around the body; each toothed slot is perpendicular to the channel and is in communication with the channel; the mechanical control assembly comprises more than one pin ring; a quantity of the pin ring is the same as a quantity of the toothed slot; each pin ring is slidably received in a corresponding toothed slot; each pin ring comprises a second spring, a first portion and a second portion; one end of the first portion abuts against one end of the second portion; another end of the first portion and another end of the second portion abut against two ends of the second spring respectively; the first portion and the second portion are provided with teeth respectively corresponding to the bitting cuts at positions corresponding to the channel; a weighed plate groove is provided at a predetermined position on each of the first portion and the second portion; when unlocking the security lock; the weighed plate inserts into the weighed plate grooves.

10. The security lock of claim 1, wherein the key cylinder also comprises a shell, and a sleeve cylinder that sleeves the body; the body is received in the sleeve cylinder by interference fit; the sleeve cylinder; the body and the cap are all within shell.

* * * * *